US006305999B1

(12) United States Patent
Toyama et al.

(10) Patent No.: US 6,305,999 B1
(45) Date of Patent: Oct. 23, 2001

(54) OUTBOARD MOTOR

(75) Inventors: Takeshi Toyama; Satoshi Isobe, both of Hamamatsu; Keiji Imanaga, Shizuoka-Ken, all of (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/577,611

(22) Filed: May 25, 2000

(30) Foreign Application Priority Data

May 31, 1999 (JP) ..... 11-153041
May 25, 1999 (JP) ..... 11-145645

(51) Int. Cl.[7] ..... B63H 21/38
(52) U.S. Cl. ..... 440/88; 440/89
(58) Field of Search ..... 440/88, 89

(56) References Cited

U.S. PATENT DOCUMENTS 5,934,957 * 8/1999 Sato et al. ..... 440/88
6,012,956 * 1/2000 Mishima et al. ..... 440/88

FOREIGN PATENT DOCUMENTS 8-1000658A 4/1996 (JP) .
10-218090-A * 8/1998 (JP) .
10-339163A 12/1998 (JP) .

* cited by examiner

*Primary Examiner*—Sherman Basinger
(74) *Attorney, Agent, or Firm*—Oblon, Spivak, McClelland, Maier & Neustadt, P.C.

(57) ABSTRACT

An outboard motor includes an engine holder, an engine which is disposed above the engine holder in a state of the outboard motor mounted to a hull and in which a crankshaft extends substantially perpendicularly, and an oil pan disposed below the engine holder. A drive shaft housing is disposed below the oil pan and is formed with an exhaust chamber and a water pump is driven by the drive shaft so as to pump up a cooling water. A cooling water passage is formed in the oil pan and the drive shaft housing to guide the cooling water pumped up by the water pump to the engine. A relief valve is disposed on the way of the cooling water passage so as to discharge the cooling water into the exhaust chamber.

7 Claims, 11 Drawing Sheets

OUTBOARD MOTOR

BACKGROUND OF THE INVENTION

1. Field of the Invention

The present invention relates to an outboard motor having an improved structure of a cooling water passage and an associated structure.

2. Discussion of the Background

Engines of outboard motors include an engine, generally of water-cooling type, having a cylinder block in which a plurality of cylinders are arranged in a vertical direction. In a cylinder head connected to the cylinder block, intake ports and exhaust ports are formed for the respective cylinders. Exhaust gas discharged from the exhaust ports is collected into a common exhaust passage and then discharged out from the outboard motor.

Since the exhaust passage is heated to a very high temperature by the exhaust gas, a cooling water passage is formed around the exhaust passage to cool the exhaust passage by means of cooling water. Such a cooling water passage is provided for members of the engine, such as cylinder block, an engine holder and an oil pan, through which the exhaust passage passes.

However, in a conventional structure, since fastening bolts for connecting the engine holder and the oil pan are disposed only around the members mentioned above, a pressure acting on a juncture (mating) surface between the engine holder and the oil pan near the central portion of both these members adversely becomes lower than that of a peripheral portion of the juncture surface. As a result, in a case where the cooling water passage is formed nearer to the central portions of the engine holder and the oil pan, if the cooling water pressure becomes high, the cooling water leaks from the central portion of the juncture surface of both the members.

It is possible to arrange the cooling water passage closer to the peripheral portions of the engine holder and the oil pan than to the exhaust passage. However, in such a case, the engine holder can not be formed with a gas collecting port of the exhaust gas and the oil pan can also not be formed with a water checking port, for example.

In the meantime, in the outboard motor equipped with the water-cooled engine, respective parts or elements of the engine are cooled by sea water, lake water, river water or like which is pumped up by a water pump driven by a drive shaft, and after cooling, such water is discharged outward.

At a time when the temperature of the cooling water is low just after the starting of the engine operation, for example, the flow of the cooling water is interrupted by a thermostat valve provided for the engine to thereby assist or promote a warm-up of the engine.

However, during an engine warm-up operation, in spite of the fact that the flow of the cooling water is interrupted by the thermostat valve, the water pump is driven, so that the water pressure in a upstream side of a cooling water passage of the thermostat valve is increased. In order to obviate such defect and protect a seal portion or like of the cooling water passage, in the prior art, there is provided a water pressure valve, for example, as a relief valve, to the cooling water passage at a portion upstream side of the thermostat valve to thereby discharge a portion of the cooling water of which pressure is excessively increased outside the cooling water passage.

Japanese Patent Laid-open Publication No. HEI 8-100658 discloses one example of such water pressure valve, which is disposed inside the engine and Japanese Patent Laid-open Publication No. HEI 10-339163 discloses a structure in which a box-shaped passage casing is mounted to a bottom surface of an oil pan disposed below the engine to guide the cooling water into this casing and a water pressure valve is mounted to this case.

However, these prior art publications provide the following problems or defects.

That is, in the case where the water pressure valve is disposed in the inside portion of the engine, a layout of other equipments or members in the engine will be damaged and, moreover, it will be necessary to locate a specific discharge passage for discharging the cooling water from the water pressure valve, so that the number of the parts will be increased and the entire structure of the engine will be made complicated, thus providing a problem.

Furthermore, in the case where the passage casing is mounted to the bottom surface of the oil pan, the number of parts or elements will be increased and, moreover, since the bottom surface of the oil pan is made flat, lubrication oil will not be sufficiently discharged at a time of exchanging the oil.

Additionally, in the outboard motor shown in the Japanese Patent Laid-open Publication No. HEI 10-339163, an inside portion of a drive shaft housing disposed below the oil pan is divided by a partition wall into an exhaust chamber and a space in which cooling equipments or like are arranged, and the cooling water from the water pressure valve is discharged into this space. However, the wall portion of the drive shaft housing on the side of the exhaust chamber is heated by the exhaust gas and its temperature is increased, so that there is caused a problem of adhesion of calcium, for example, contained in the sea water to the drive shaft housing wall, thus being inconvenient.

SUMMARY OF THE INVENTION

The present invention has been accomplished in view of the above circumstances, and it is a primary object of the present invention to provide an outboard motor capable of arranging a cooling water passage nearer to a central portion of an engine unit than to an exhaust passage by increasing a pressure acting on a juncture surface of the engine unit near the central portion thereof.

Another object of the present invention is to provide an outboard motor having a cooling water passage of an improved structure making the entire structure of the outboard motor compact.

A further object of the present invention is to provide an outboard motor having an improved cooling water passage structure capable of reducing an exhaust gas temperature and a temperature in an exhaust chamber and capable of improving a lubrication oil discharging performance.

A still further object of the present invention is to provide an outboard motor having an improved structure for mounting a water pressure valve to the cooling water passage.

These and other objects can be achieved according to the present invention by providing, in one aspect, an outboard motor comprising:

an engine holder;

an engine which is disposed above the engine holder in a state of the outboard motor to be mounted to a hull and in which a crankshaft extends substantially perpendicularly;

an oil pan disposed below the engine holder;

a drive shaft housing disposed below the oil pan;

an exhaust passage formed in the engine, the engine holder and the oil pan for discharging an exhaust gas from the engine in the drive shaft housing; and a cooling water passage and a return-water passage disposed in a vicinity of the exhaust passage; and fixing means disposed in the engine holder for fixing the oil pan to the engine holder.

In a preferred embodiment of this aspect, the engine holder and the oil pan are provided with vertical wall sections forming the exhaust passage, the cooling water passage and the return-water passage and forming with a juncture portion between the engine holder and the oil pan and the fixing means is provided for the vertical wall sections. The engine holder and the oil pan are provided with outer wall sections forming the exhaust passage, the cooling water passage and the return-water passage and forming the juncture portion between the engine holder and the oil pan, the outer wall sections are connected to the engine by fixing means at a plurality of locations.

The engine holder and the oil pan are provided with vertical wall sections forming the exhaust passage, the cooling water passage and the return-water passage and forming a juncture portion between the engine holder and the oil pan, the vertical wall sections being connected by means of rib, and the fixing means is provided at an intersection between the vertical wall sections and the rib. The holder and the oil pan are provided with outer wall sections forming the exhaust passage, the cooling water passage and the return-water passage and forming the juncture portion between the engine holder and the oil pan, the outer wall sections are connected to the engine by fixing means at a plurality of locations.

As explained above, according to this first aspect of the outboard motor of the present invention of the structures mentioned above, the engine is disposed above the engine holder, and the oil pan is disposed below the engine holder, the drive shaft housing is disposed below the oil pan, the exhaust gas from the engine is discharge into the drive shaft housing through the exhaust passage formed in the engine, the engine holder and the oil pan, the cooling water passage and the return-water passage are provided around the exhaust passage, and the connecting means for connecting the engine holder and the oil pan is provided in the engine holder. Therefore, the pressure on the juncture surface between the engine holder and the oil pan is increased and the sealing performance of the cooling water passage can be enhanced. Further, the vertical walls forming the exhaust passage, the cooling water passage and the return-water passage and forming a juncture between the engine holder and the oil pan are formed in the engine holder and the oil pan, and the vertical walls are provided with the connecting means. Therefore, the pressure on the center portion of the juncture surface between the engine holder and the oil pan is increased and the sealing performance can be enhanced.

Furthermore, the vertical walls forming the exhaust passage, the cooling water passage and the return-water passage and forming a juncture between the engine holder and the oil pan are formed in the engine holder and the oil pan, and the connecting means is provided at an intersection between the vertical walls and the connecting rib which connects the vertical walls to each other. Therefore, the pressure on the center portion of the juncture surface between the engine holder and the oil pan is further increased and the sealing performance is enhanced.

Still furthermore, the outer walls of the engine holder and the oil pan which form the exhaust passage, the cooling water passage and the returning-water passage, and form the juncture between the engine holder and the oil pan are connected to the engine by connecting means at a plurality of locations. Therefore, the pressure on the juncture surface between the engine holder and the oil pan is increased and the sealing performance can be improved.

According to another aspect of the present invention, there is provided an outboard motor comprising:

an engine holder;

an engine which is disposed above the engine holder in a state wherein the outboard motor is mounted to a hull and in which the crankshaft extends substantially perpendicularly;

an oil pan disposed below the engine holder;

a drive shaft housing which is disposed below the oil pan and in which an exhaust chamber is formed and a drive shaft extends vertically;

a water pump driven by the drive shaft so as to pump up cooling water;

a cooling water passage formed in the oil pan and the drive shaft housing to guide the cooling water pumped up by the water pump to the engine; and a relief valve disposed in the the cooling water passage so as to discharge the cooling water into the exhaust chamber.

In a preferred embodiment of this aspect, the oil pan is provided, at a bottom surface thereof, with a horizontal cooling water passage which extends in a horizontal direction and to which the cooling water is guided from the water pump, provided with a vertical cooling water passage extending towards the engine from an intermediate portion of the horizontal cooling water passage and provided with a relief port disposed at a portion upstream side of a connecting portion of the horizontal and vertical cooling water passages so as to be opened towards the exhaust chamber, the relief valve being mounted to the relief port. The bottom surface of the oil pan is vertically staged to provide a low level portion and a high level portion and an oil drain port is formed to a wall section of the oil pan at the low level portion side. The oil pan is formed, at the bottom surface thereof, with a boss for mounting the relief valve.

According to this second aspect of the present invention of the structure mentioned above, the drive shaft housing is disposed below the oil pan and the exhaust chamber is formed in the drive shaft housing in which the drive shaft extends vertically, the water pump is driven so as to pump up the cooling water, the cooling water passage is formed in the oil pan and the drive shaft housing to guide the cooling water pumped up by the water pump to the engine, and the relief valve is disposed on the way of the cooling water passage so as to discharge the cooling water into the exhaust chamber. Accordingly, the exhaust gas is effectively cooled and, hence, effect of increasing of the temperature of the drive shaft housing wall can be effectively prevented.

Furthermore, the oil pan is provided with the horizontal cooling passage and the vertical cooling water passage, and the relief port is disposed at a portion upstream side of a connecting portion of the horizontal and vertical cooling water passages so as to be opened towards the exhaust chamber. The relief valve is mounted to this relief port. According to such arrangement, the cooling water passage and the relief valve mounting structure can be made compact.

The formation of the oil drain port to the wall section of the oil pan at the lower level bottom portion makes smooth the lubrication oil discharging. Since the oil pan is formed, at the bottom surface thereof, with a boss for mounting the relief valve, the structure can be further made compact and the assembling performance can be improved.

The nature and further characteristic features of the present invention will be made more clear from the following descriptions made with reference to the accompanying drawings.

DESCRIPTION OF THE PREFERRED EMBODIMENTS

Preferred embodiments of the present invention will be described hereunder with reference to the accompanying drawings.

The first embodiment of the present invention will be explained with reference to FIGS. 1 to 6.

Figure 1:
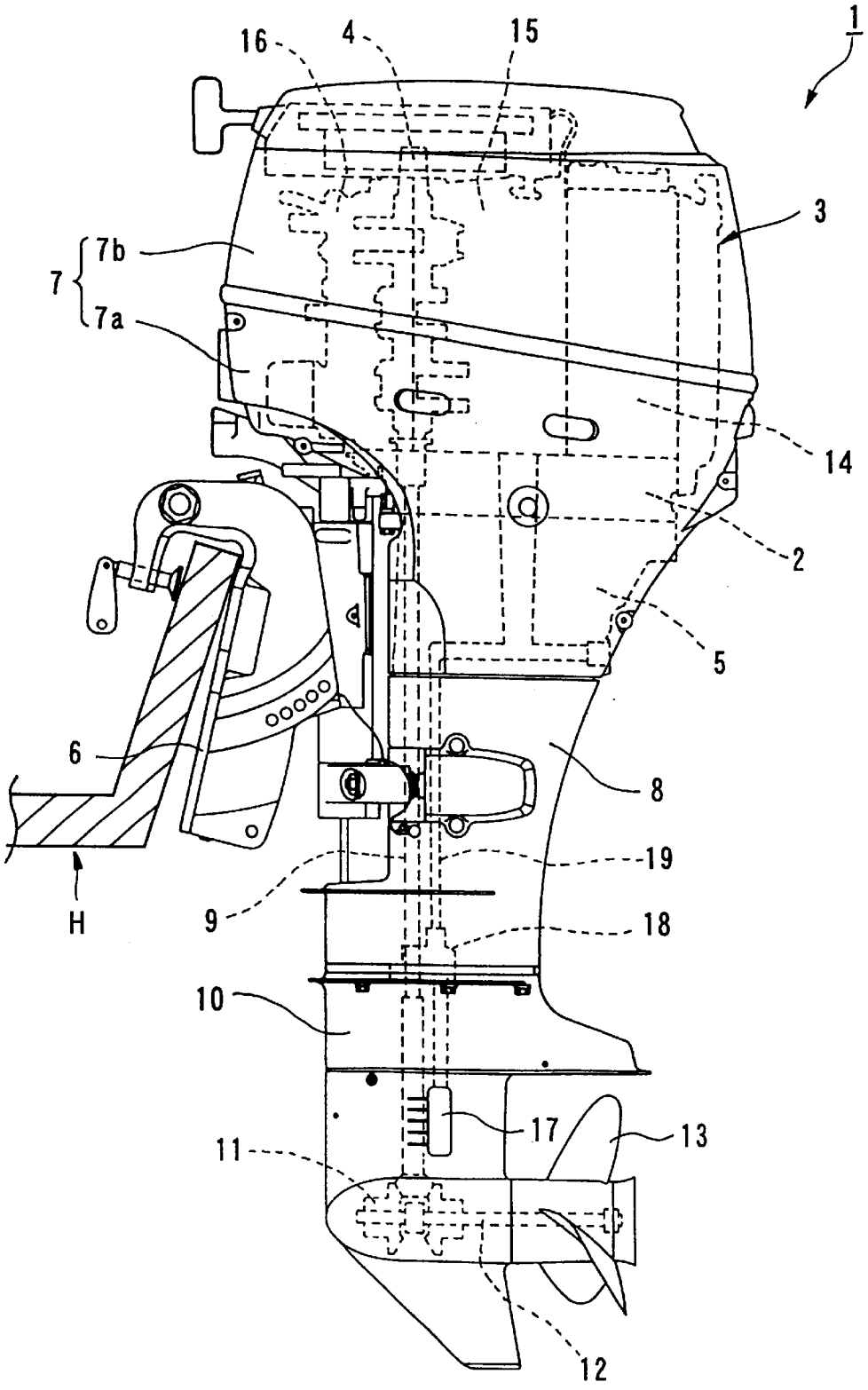
FIG. 1 is a left side view showing an outboard motor in a state to be mounted to a hull, for example, to which the present invention is applicable.

As shown in FIG. 1, the outboard motor 1 is in a state mounted to a hull H and includes an engine holder 2 and an engine 3 disposed above the engine holder 2. The engine 3 is a vertical type engine in which a crankshaft 4 is disposed substantially vertically.

An oil pan 5 is disposed below the engine holder 2, a bracket 6 is mounted to the engine holder 2 for example, and the outboard motor 1 is mounted to a transom of a hull H through the bracket 6. Peripheries of the engine 3, the engine holder 2 and the oil pan 5 of the outboard motor 1 are covered with an engine cover 7. The engine cover 7 comprises a lower cover section 7*a* covering the lower portion of the engine 3, the engine holder 2 and the oil pan 5 and an upper cover section 7*b* covering the upper portion of the engine 3.

A drive shaft housing 8 is disposed at a lower portion of the oil pan 5. A drive shaft 9 is disposed substantially vertically in the engine holder 2, the oil pan 5 and the drive shaft housing 8, and an upper end of the drive shaft 9 is connected to a lower end of the crankshaft 4. The drive shaft 9 extends downward in the drive shaft housing 8 for driving a propeller 13 through a bevel gear 11 and a propeller shaft 12 housed in a gear case 10 provided in a lower portion of the drive shaft housing 8.

The engine 3 mounted to the outboard motor 1 is a water-cooled four-stroke-cycle three-cylinder engine, which comprises, in combination, a cylinder head 14, a cylinder block 15, a crankcase 16 and the like. This engine 3 is a water-cooled engine which takes seawater, lake water or river water into the engine 3 from an intake port 17 provided in the gear case 10 to use the water as cooling water.

The cylinder block 15 is disposed rearward (right side) of the crankcase 16 disposed at the leftmost position in FIG. 1. The cylinder head 14 is disposed rearward the cylinder block 15.

With reference to FIGS. 2 to 6, the drive shaft housing 8 is provided at its bottom portion, with a water pump 18 connected to the intake port 17. The water pump 18 is driven by the drive shaft 9, and a water-feed pipe 19 extending upward from the water pump 18 is disposed.

The oil pan 5 is formed, at its bottom portion, with a horizontally extending lateral cooling water passage (horizontal cooling water passage) 20. The horizontal cooling water passage 20 is provided at its upstream end with a cooling water inlet 20*a*, and a downstream end of the water-feed pipe 19 is connected to the cooling water inlet 20*a*. A vertical cooling water passage 21 surrounded by an outer wall 5*a* and a vertical wall 5*b* of the oil pan 5 extends upward from an intermediate portion of this cooling water passage 20. The outer wall 5*a* of the oil pan 5 is formed with a cooling water take-out port 22 for checking water.

The engine holder 2 is formed with a cooling water passage 23 passing through the engine 3 in the vertical direction and surrounded by an outer wall 2*a* and a vertical wall 2*b* of the engine holder 2, and the cooling water passage 23 is connected to the downstream end of the vertical cooling water passage 21 of the oil pan 5. A downstream end of the cooling water passage 23 is connected to a cooling water jacket, not shown, formed in the engine 3.

Cooling water which has cooled various portions of the engine 3 is introduced, as return water, into return-water passages 24 and 25 formed in the engine holder 2 and the oil pan 5 so as to be surrounded by the outer walls 2*a* and 5*a* and the vertical walls 2*b* and 5*b* of the engine holder 2 and the oil pan 5. The oil pan 5 is formed, at its bottom surface, with a return-water outlet 26 through which the return-water is discharged into the space formed in the drive shaft housing 8.

On the other hand, the exhaust gas from each cylinder of the engine 3 is discharged into the space formed in the drive shaft housing 8 through exhaust passages 27 and 28 formed in the engine holder 2 and the oil pan 5. The exhaust passages 27 and 28 pass through the engine holder 2 and the oil pan 5 in the vertical direction and are formed so as to be surrounded by the outer walls 2*a* and 5*a*, and the vertical walls 2*b* and 5*b* forming the cooling water passages 21 and 23 and the return-water passages 24 and 25. The exhaust passages 27 and 28 are disposed so as to be deviated towards one side from the center line connecting front and rear portions of the outboard motor 1, i.e., left side in the present embodiment. The outer wall 2*a* of the engine holder 2 is formed with an exhaust gas collecting port 29 connected to the exhaust passage 27.

The vertical cooling water passage 21 of the oil pan 5, the cooling water passage 23 of the engine holder 2, and the return-water passages 24 and 25 formed in the engine holder 2 and the oil pan 5 are disposed around the exhaust passages 27 and 28. The exhaust gas is cooled by the cooling water and the return-water.

Figure 6:
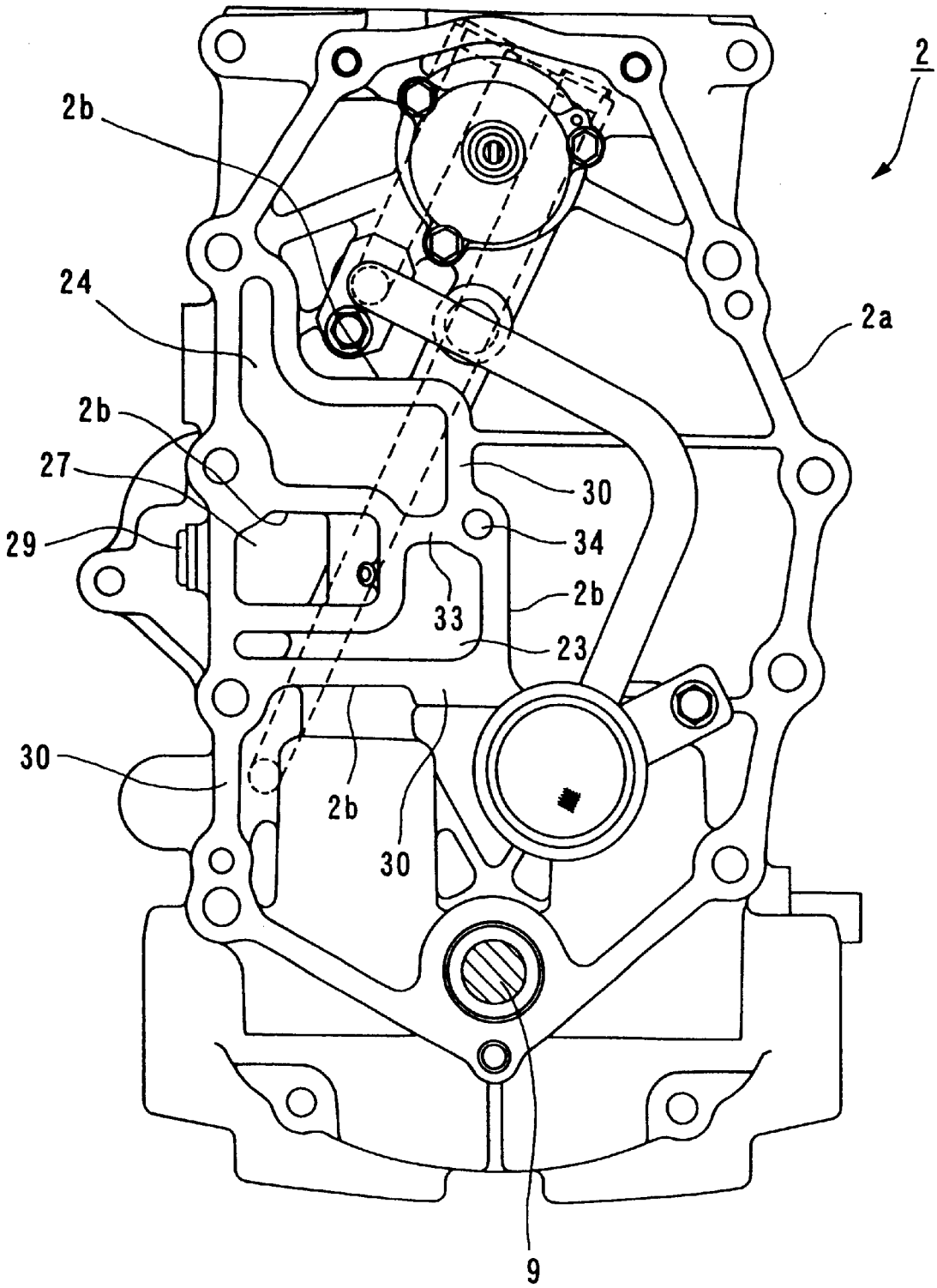
FIG. 6 is a bottom plan view of the engine holder of FIG. 5.

As shown in FIG. 6, for example, the cooling water passage 23 formed in the engine holder 2 is disposed so that the passage 23 is formed into a substantially L-shape extending from a front side of the exhaust passage 27 to a portion close to the central portion of the engine holder 2 on the opposite side from the exhaust gas collecting port 29. The return-water passage 24 is formed in the engine holder 2 on the rear side of the exhaust passage 27.

Figure 3:
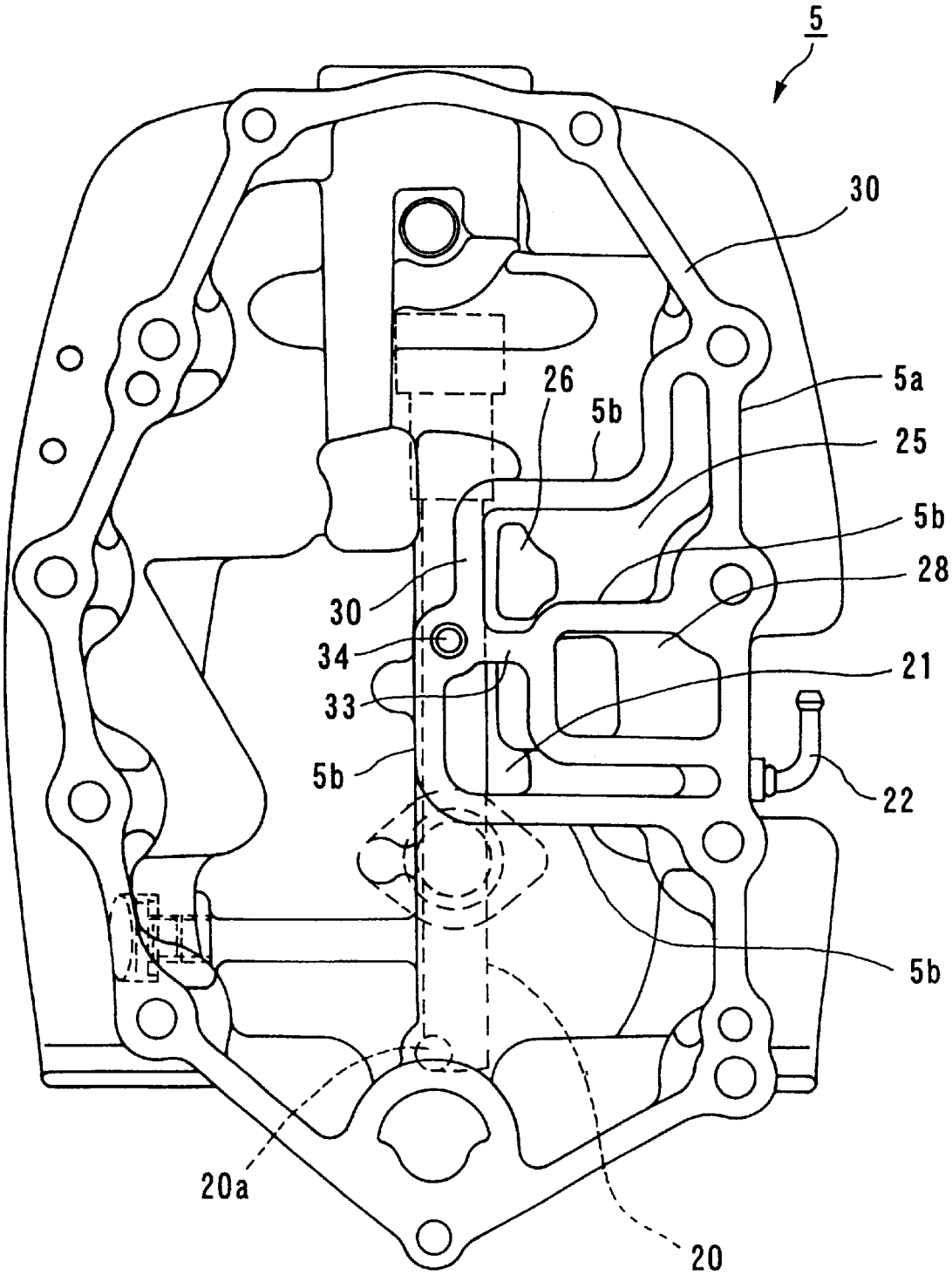
FIG. 3 is a top plan view of an oil pan of the outboard motor of this embodiment.

The outer wall 2*a* around the engine holder 2 and a lower surface of the vertical wall 2*b* forming the cooling water passage 23, the return-water passage 24 and the exhaust passage 27 formed in the outer wall 2*a*; as well as the outer wall 5*a* of the periphery of the oil pan 5 and an upper surface of the vertical wall 5*b* forming the vertical cooling water passage 21 and the exhaust passage 28 formed in the outer wall 5*a*; are aligned with each other to form a juncture (mating) surface 30 tightly contacting to each other (see FIGS. 3 and 6).

The engine holder 2 and the oil pan 5 are fastened together to the engine 3, comprising the cylinder head 14, the cylinder block 15 and the crankcase 16, by means of a plurality of through bolts 31 as connecting means after the engine holder 2 and the oil pan 5 have been previously connected to the juncture surface 30 by plurality of other bolts 32. Gaskets are interposed between the engine 3 and the engine holder 2 at its juncture (mating) surface and between the engine holder 2 and the oil pan 5 at the juncture surface 30 thereof.

Figure 4:
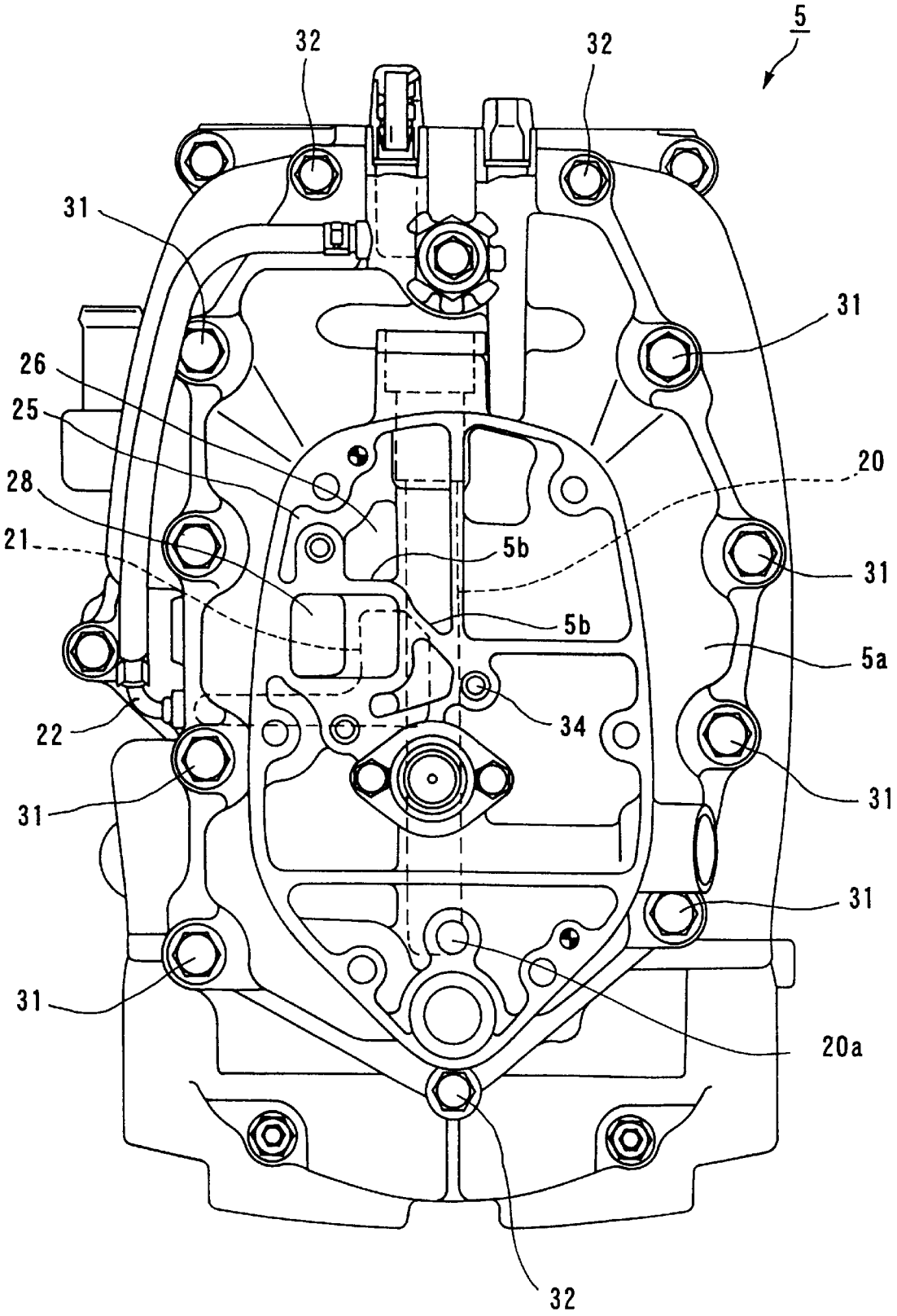
FIG. 4 is a bottom plan view of the oil pan of FIG. 3.
Figure 5:
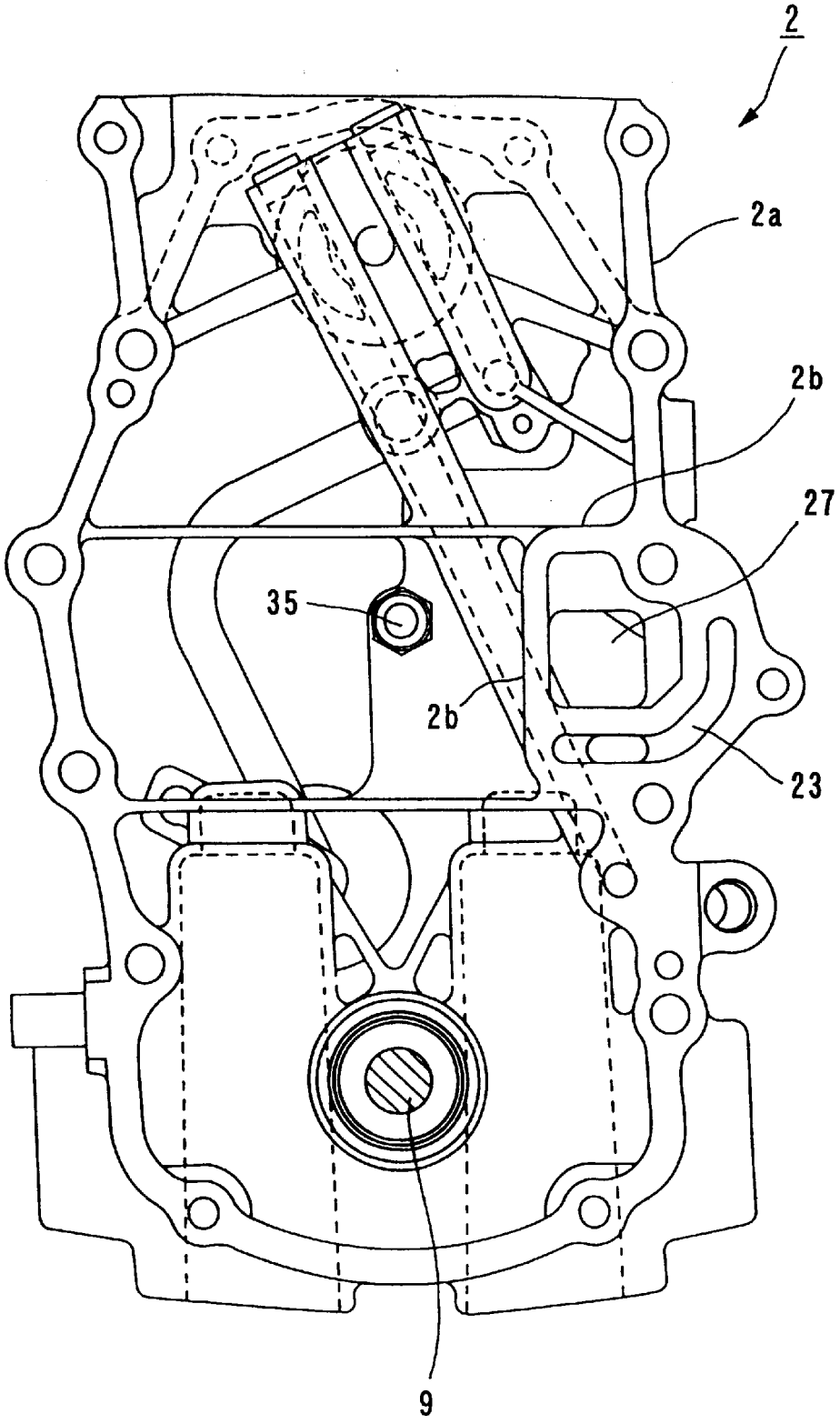
FIG. 5 is a top plan view of an engine holder of the outboard motor of the first embodiment.

As shown in FIG. 4, for example, four through bolts 31 for fastening the engine holder 2 and the oil pan 5 to the engine 3 are disposed on each of the opposite sides of the outer wall 5*a* of the periphery of the oil pan 5, i.e., in total, eight through bolts 31 are disposed, and are inserted toward the engine holder 2 from the lower portion of the oil pan 5. The bolts 32 previously connecting the engine holder 2 and the oil pan 5 are disposed so that one of the bolts 32 is disposed at the front side of the periphery of the oil pan 5 for example, and two bolts 32 are disposed at the rear side thereof, and three, in total, bolts are disposed. The bolts 32 are also inserted towards the engine holder 2 from the lower portion of the oil pan 5.

A bolt hole 34 is formed at an intersecting portion between the vertical walls 2*b* and 5*b* forming the cooling water passages 21 and 23, the return-water passages 24 and 25 and the exhaust passages 27 and 28 in the engine holder 2 and the oil pan 5, and the rib 33 for connecting the vertical walls 2*b* and 5*b*. A bolt 35 as connecting means is inserted into the bolt hole 34 from the upper surface side of the engine holder 2 towards the oil pan 5 disposed below and is fastened thereto (see FIGS. 2 and 5). With this structure, substantially central portions of the engine holder 2 and the oil pan 5 as viewed from top are connected.

The first embodiment of the present invention mentioned above will operate in the following manner.

When the engine 3 is driven and the drive shaft 9 is rotated, the cooling water is pumped up by the water pump 18, and the cooling water is introduced from the cooling water inlet 20*a* through the water-feed pipe 19 into the horizontal cooling water passage 20 and the vertical cooling water passage 21 formed in the oil pan 5. The cooling water is then introduced into the various portions of the engine 3 through the cooling water passage 23 formed in the engine holder 2. The cooling water which has cooled the various portion of the engine 3 is discharged to the space formed in the drive shaft housing 8 through the return-water passages 24 and 25.

On the other hand, the exhaust gas is discharged from each cylinder in accordance with the engine operation into the drive shaft housing 8 through the exhaust passage 27 in the engine holder 2 and the exhaust passage 28 in the oil pan 5.

In the present invention, the cooling water passages 21 and 23, and the return-water passages 24 and 25 formed in the engine holder 2 and the oil pan 5 are disposed around the exhaust passages 27 and 28, and the exhaust gas is cooled by the cooling water and the return-water. Therefore, a temperature in the drive shaft housing 8 is restrained from increasing, and it is possible to prevent calcium from adhering to the outer wall of the drive shaft housing 8.

Among the outer walls 2*a* and 5*a*, and the vertical walls 2*b* and 5*b*, the outer walls 2*a* and 5*a* can provide sufficient sealing performance because the through bolts 31 disposed at the opposite sides of the outer wall 5*a* of the periphery of the oil pan 5 fasten the engine holder 2 and the oil pan 5 to the engine 3 so as to apply a pressure to the juncture surface 30 of the peripheral portion of the engine holder 2 and the oil pan 5.

On the other hand, the vertical walls 2*b* and 5*b* can provide sufficient sealing performance because the bolt 35 provided at the intersection of the vertical walls 2*b*, 5*b* and the rib 33 connecting the vertical walls 2*b*, 5*b* connects the engine holder 2 and the oil pan 5 to each other, thereby applying a pressure to the juncture surface 30 of the central portions of the engine holder 2 and the oil pan 5.

As a result, even if the cooling water pressure is increased, no cooling water leaks from the juncture surface 30 at the central portions of the engine holder 2 and the oil pan 5, so that the cooling efficiency of the engine 3 and the exhaust gas can be enhanced.

Further, the cooling water passages 21 and 23 and the return-water passages 24 and 25 can be disposed nearer to the central portions of the engine holder 2 and the oil pan 5 than to the exhaust passages 27 and 28, so that the engine holder 2 can be formed with the collecting port 29 of the exhaust gas and the oil pan 5 can be formed with cooling water outlet 22 for checking the cooling water.

A second embodiment of the outboard motor of the present invention will be described hereunder with reference to FIG. 1 and FIGS. 7–11, in which FIG. 1 is used for a common view to the first and second embodiments and the reference numerals 1 to 19 in FIG. 1 are commonly used hereunder for the second embodiment as like in the first embodiment.

Figure 2:
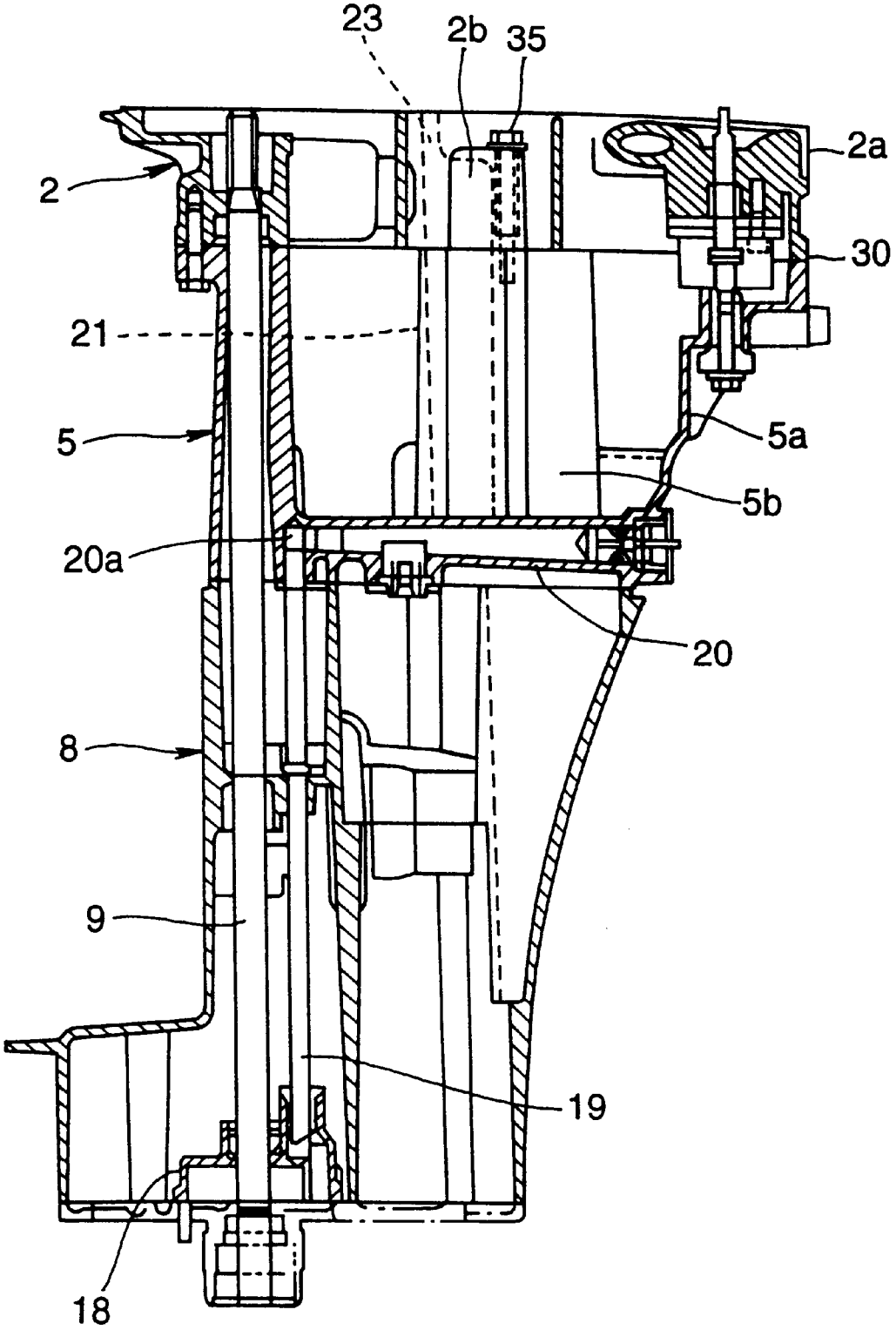
FIG. 2 is an enlarged vertical sectional view of a central portion of the outboard motor according to a first embodiment of the present invention.
Figure 7:
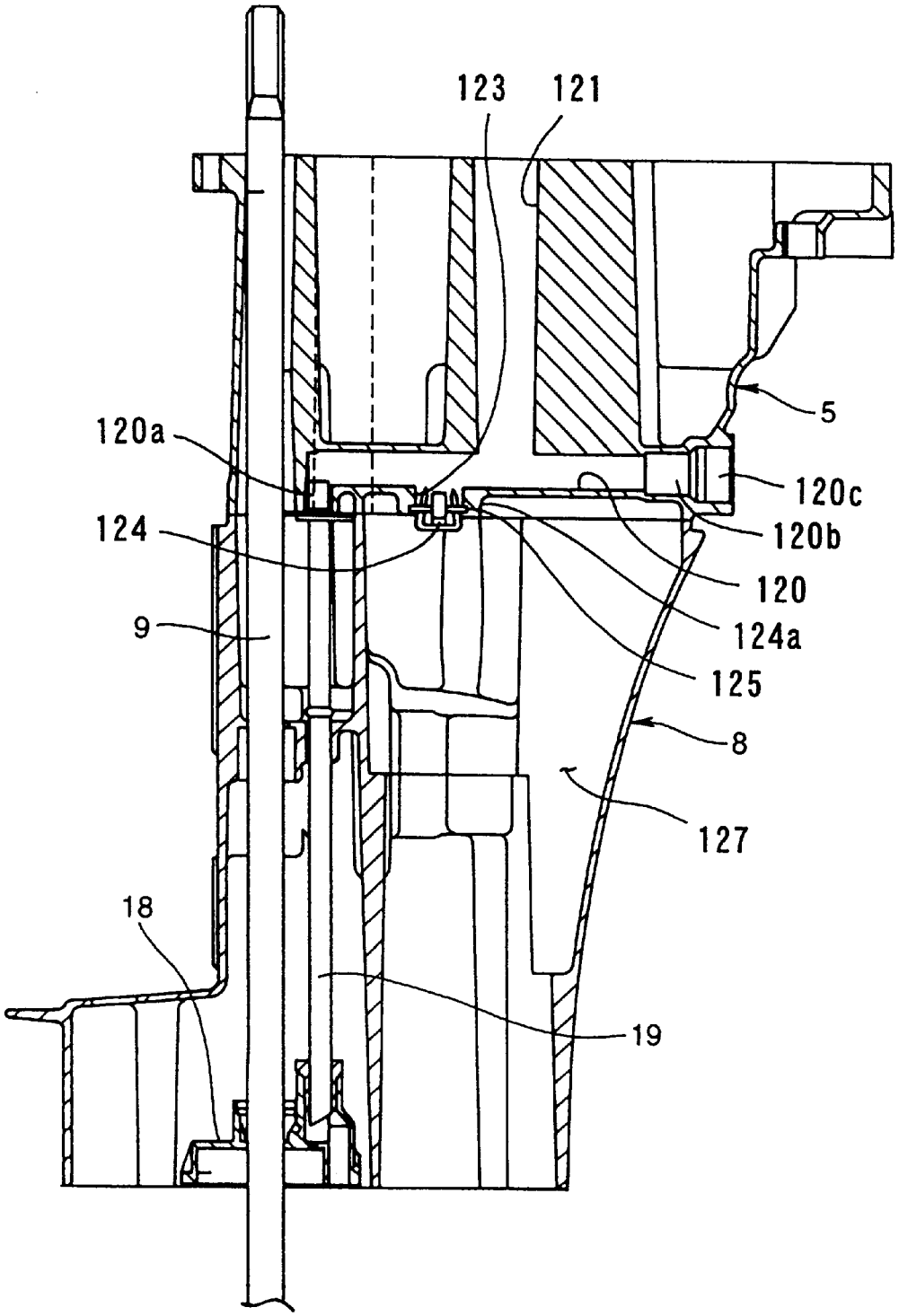
FIG. 7 is a view similar to FIG. 2 showing a sectional view of the central portion of the outboard motor according to a second embodiment of the present invention.
Figure 8:
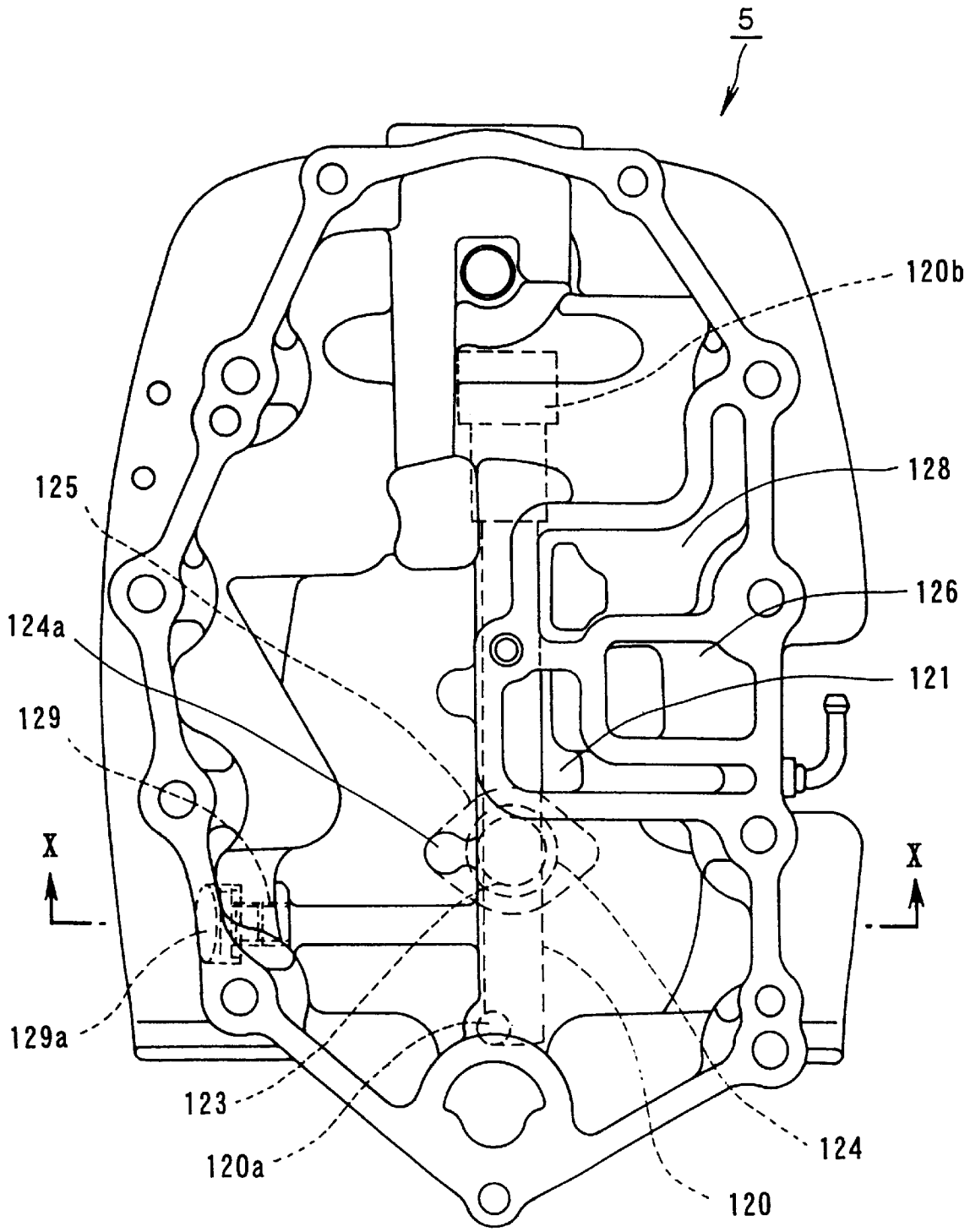
FIGS. 8 and 9 are views similar to those of FIGS. 3 and 4 of the first embodiment, but which relate to the second embodiment.
Figure 9:
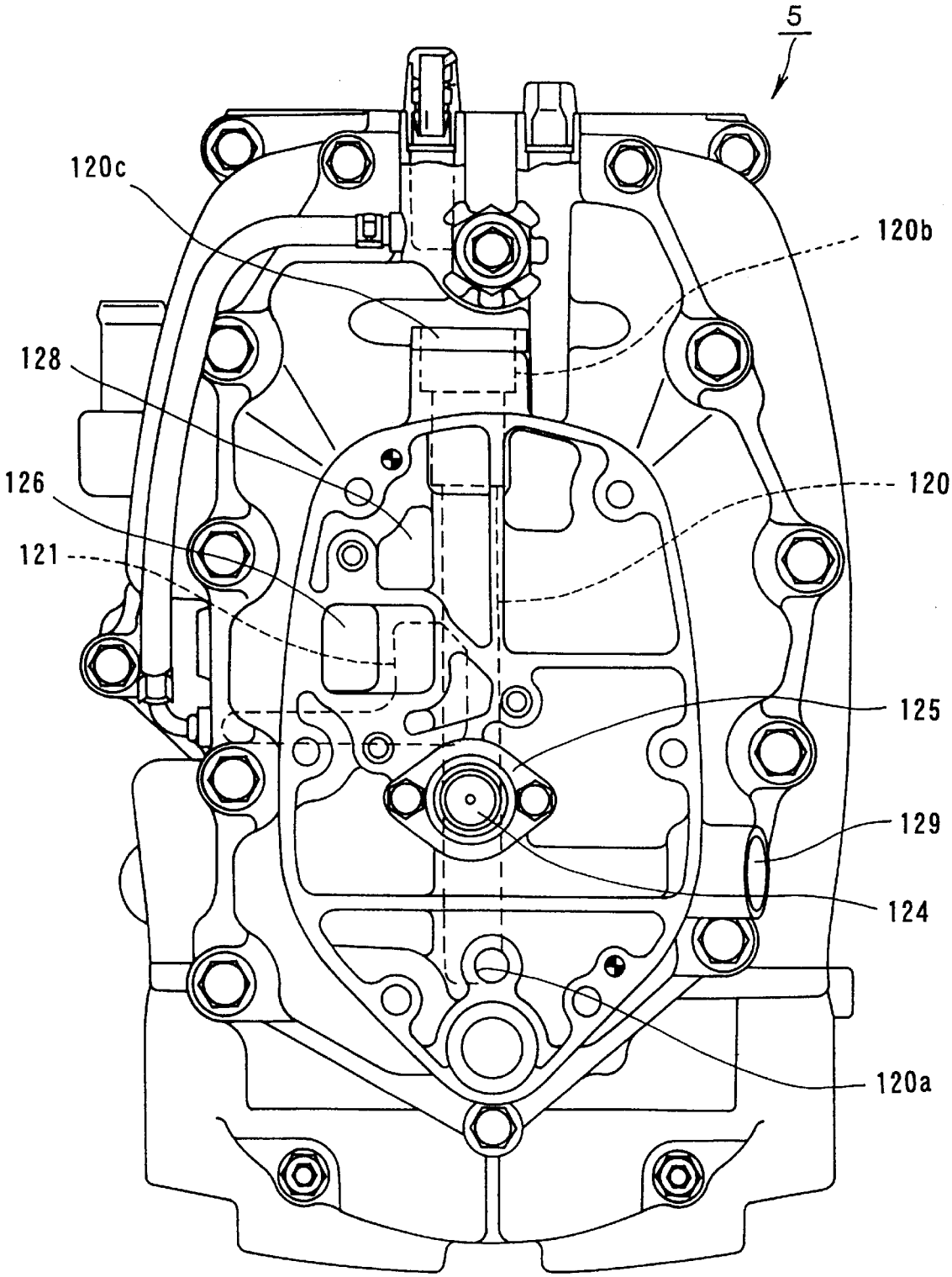

FIGS. 7 to 9 are views similar to FIGS. 2 to 4, in which FIGS. 2 and 7 are views showing a central portion of the outboard motor in an enlarged scale and FIGS. 3–4 and 8–9 are views representing the oil pan.

With reference to FIG. 7, the engine 3 of the outboard motor 1 is a water-cooled engine provided with the gear case 10 to which is formed the intake port 17 through which the cooling water such as sea water, lake water, river water or like is introduced into the engine to cool the same by the water pump 18 disposed at the bottom portion of the drive shaft housing 8 and driven by the drive shaft 9. The thus taken cooling water then rises upward through the water-feed pipe 19, as the cooling water passage, in the drive shaft housing 8 and then guided towards the engine 3 through a cooling water passages 120, 121 and 122 formed in the engine holder 2 and the oil pan 5.

With reference to FIGS. 1 and 8–9, as mentioned with reference to the first embodiment, the horizontal cooling water passage 120 is formed integrally to the bottom surface of the oil pan 5 so as to extend in the horizontal direction. The horizontal cooling water passage 120 extends in forward and backward direction at substantially the central portion of the bottom surface of the oil pan 5 and is provided, at its front end, with the cooling water intake port 120*a* opened towards the junction (mating) surface between the oil pan 5 and the drive shaft housing 8. The upper end portion of the feed-water pipe 19 is connected to the cooling water intake port 120*a*. Further, the rear end portion of the passage 120 is opened rearward of the oil pan 5 to form a flush port 120*b* which is closed by a plug 120*c*.

The vertical cooling water passage 121 vertically extending from substantially the central portion of the horizontal cooling water passage 120 towards the mating portion (junction surface) of the oil pan 5 and the engine holder 2 is formed integrally with the oil pan 5, and the upper end portion of the vertical cooling water passage 121 is connected to a cooling water passage 122 formed to the engine holder 2 as shown in FIG. 1. A thermostat valve may be disposed on the downstream side of the cooling water passage 122 formed to the engine holder 2.

A relief port 123 opened towards the space defined in the drive shaft housing 8 is formed, integrally with the oil pan 5, to the lower portion of the horizontal cooling water passage 120 on the side of the cooling water intake port 120*a*, i.e. on the upstream side of the connecting portion between the horizontal and vertical cooling water passages 120 and 121, and for example, a water pressure valve 124 is mounted to this relief port 123 as a relief valve.

Figure 11:
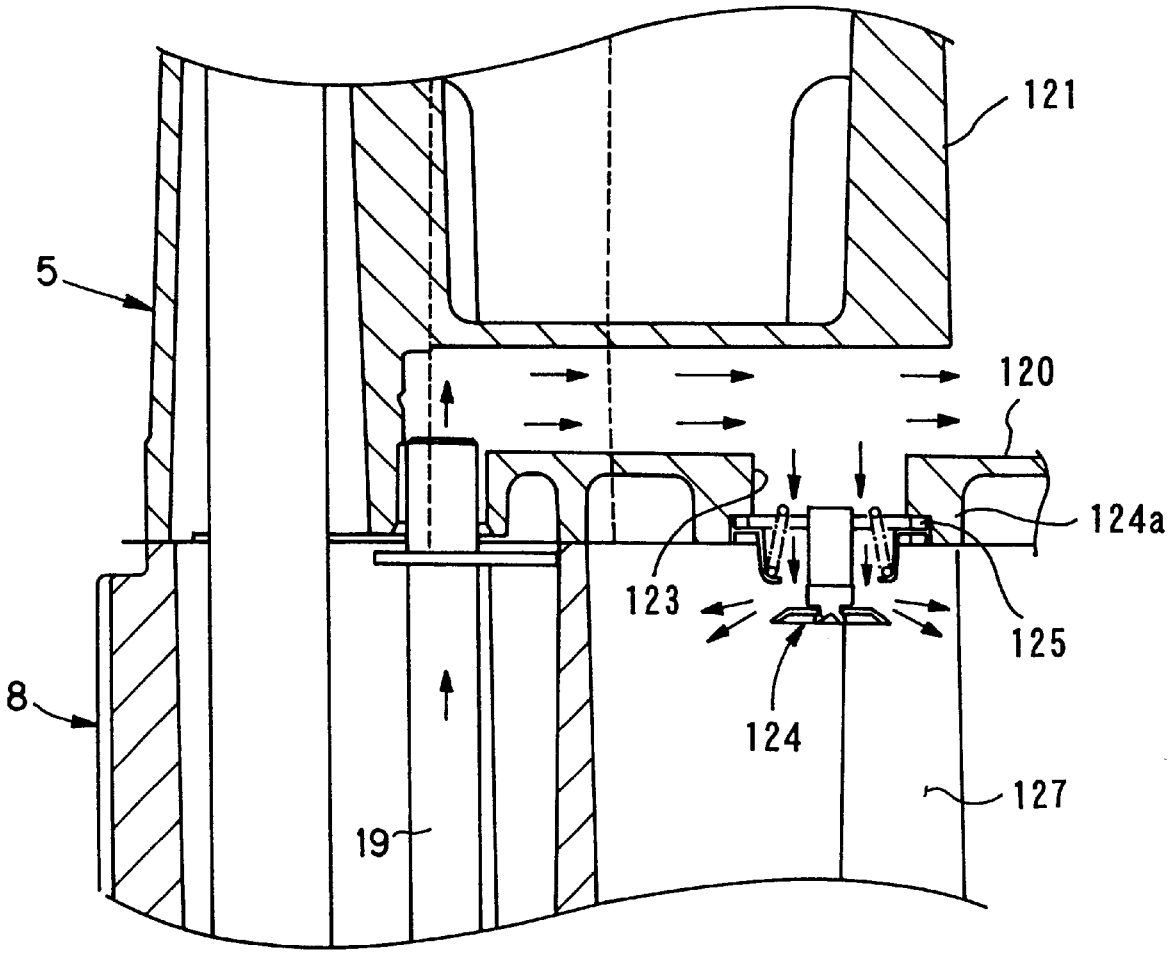
FIG. 11 is a view, in an enlarged scale, showing a portion near a relief port.

With reference to FIG. 11, which is an enlarged sectional view of a portion near the relief port 123, the water pressure valve 124 is fixed, through a metallic plate 125, to a water pressure valve mounting boss 124*a* formed to the bottom surface of the oil pan 5, for example, integrally therewith. Further, it is designed that, as shown by arrows in FIG. 11, the flowing direction of the cooling water discharged through the water pressure valve 124 is normal (perpendicular in FIG. 11) to the flow direction of the cooling water flowing through the horizontal cooling water passage 120.

Incidentally, though not shown in detail, an exhaust passage 126 is formed in the engine holder 2 in the vicinity of the vertical cooling water passage 121 and the cooling water passage 122. The exhaust passage 126 is communicated, at its upper end, with an exhaust passage formed to the cylinder block or cylinder head and, at its lower end, is opened towards the space defined in the drive shaft housing 8, this space being therefore utilized as an exhaust chamber 127.

Figure 10:
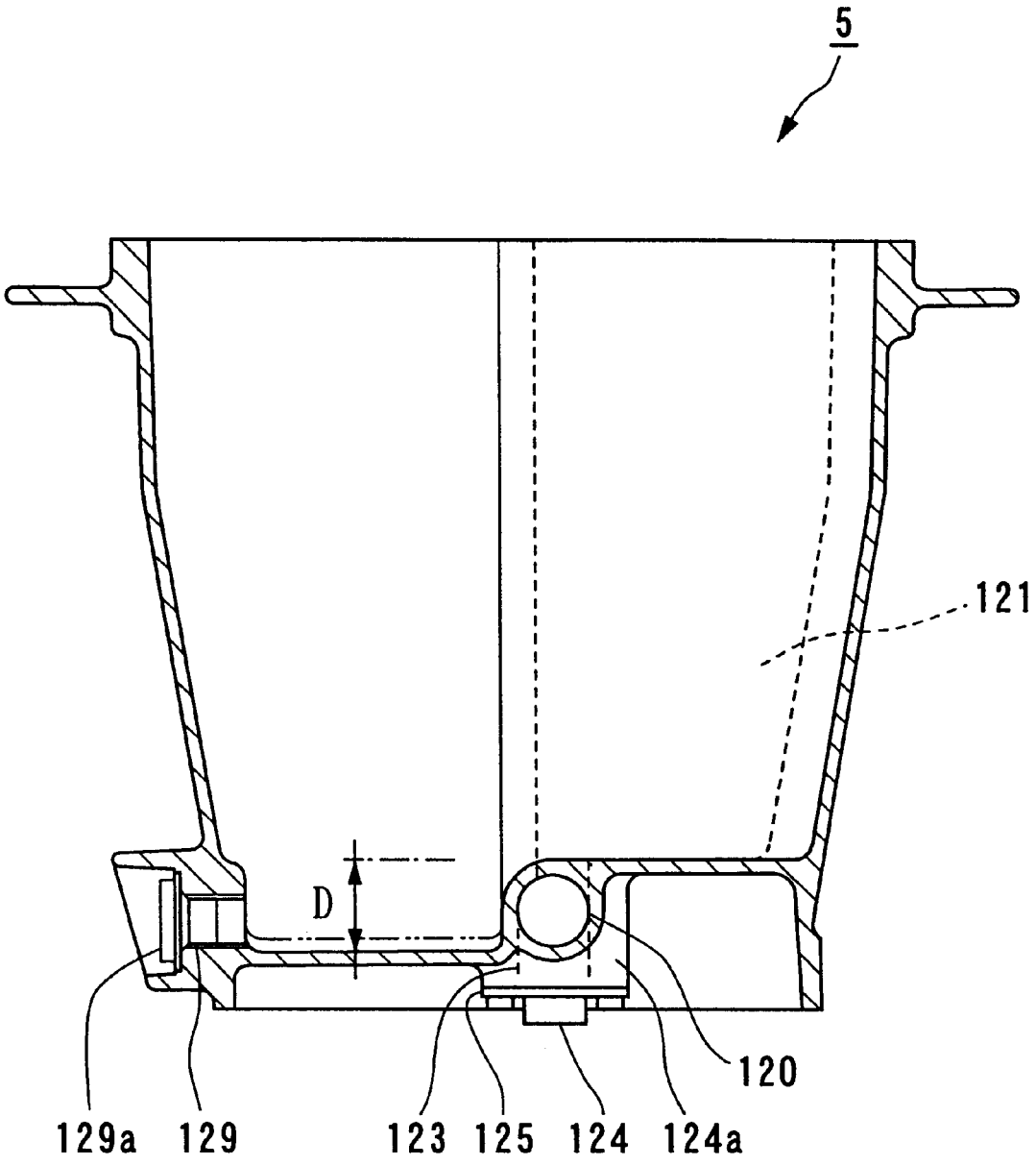
FIG. 10 is a sectional view taken along the line X—X in FIG. 8.

Furthermore, with reference to FIGS. 8 to 10, the oil pan 5 is formed with an oil drain port 129 opened sideways at a lower front portion of the oil pan 5, and the oil drain port 129 is closed by a drain cap 129*a*. As shown in FIG. 10, the bottom portion of the oil pan 5 is formed with a vertical step D having an upper level portion and a lower level portion with the horizontal cooling water passage 120 being interposed. The lower level portion is positioned at substantially the same level of the lowest portion of the drain port 129 and the upper level portion is positioned at substantially the same level as the horizontal cooling water passage 120.

The second embodiment of the structure mentioned above will attain the following operation and function.

As mentioned with reference to the first embodiment, when the engine 3 is driven and the drive shaft 9 is rotated, the cooling water is pumped up by the water pump 18, and the cooling water is introduced from the cooling water inlet 120*a* through the water-feed pipe 19 into the horizontal cooling water passage 120 and the vertical cooling water passage 121 formed in the oil pan 5. The cooling water is introduced into the various portions of the engine 3 through the cooling water passage 122 formed in the engine holder 2. The cooling water which has cooled the various portion of the engine 3 is discharged to the exhaust chamber 127 formed in the drive shaft housing 8 through the cooling water discharge passage 128.

At the time when the cooling water temperature is low, for example, just after the engine operation starting, the thermostat valve disposed downstream side of the cooling water passage 122 formed to the engine holder 2 is operated so as to shut off the cooling water flow to thereby assist or promote the engine warm-up operation.

Then, during the engine warm-up operation, the water pump 18 is driven in spite of the shut-off of the cooling water flow, and the pressure of the cooling water on the upstream side of the thermostat valve is increased. However, since the water pressure valve 124 as the relief valve is provided to the horizontal cooling water passage 120 at a portion upstream side of the thermostat valve, a portion of the cooling water of which pressure is excessively increased is discharged. At this time, the water pressure valve 124 is directed downward towards the lower portion of the horizontal cooling water passage 120, so that the cooling water is discharged into the exhaust chamber 127 formed in the drive shaft housing 8.

Furthermore, according to this embodiment, since the discharging direction of the water pressure valve 124 is set to the direction normal (i.e. perpendicular) to the cooling water flow direction in the horizontal cooling water passage 120, the cooling water collides against the water pressure valve 124 at its lower portion, so that the cooling water is splashed in all directions.

The cooling water splashed into the exhaust chamber 127 is mixed with the exhaust gas from the exhaust passage 126 and cool the gas to thereby prevent the temperature of the wall section of the drive shaft housing 8 from raising. Further, the cooling water splashed in the exhaust chamber 127 directly adheres to the inner wall section of the drive shaft housing 8, so that the temperature of the wall section of the drive shaft housing 8 is further lowered. The problem of the adhesion of calcium component in the sea water, pumped up as cooling water, to the drive shaft housing wall will be solved by lowering the temperature of the wall section thereof.

Furthermore, in the second embodiment, the horizontal cooling water passage 120 and the vertical cooling water passage 121 are formed integrally with the oil pan 5 and the water pressure valve 124 is fixed, through a metallic plate 125, to the water pressure valve mounting boss 124*a* formed to the bottom surface of the oil pan 5. Accordingly, any sealing means is not required to be located for the cooling water passage which requires water-tight performance and, hence, the number of element or part can be reduced and the entire structure can be made compact and easily assembled, thus being advantageous.

Still furthermore, the vertical step is formed to the bottom portion of the oil pan 5 and the oil drain port 129 is formed to the side wall of the lower bottom portion of the oil pan 5, so that the oil can be surely discharged at the lubrication oil exchanging time. Moreover, the oil drain port 129 will be effectively inspected and maintained by locating it at the front side of the oil pan 5.

Further, in the described embodiment, the horizontal cooling water passage 120 is formed to the oil pan 5 and the water pressure valve 124 is mounted to this horizontal cooling water passage 120. In an alternation, however, the horizontal cooling water passage may be formed to the drive shaft housing 8 and the water pressure valve 124 may be mounted to this drive shaft housing 8. Furthermore, the water pressure valve 124 may be disposed on the way of the water-feed pipe 19 disposed in the exhaust chamber 127.

It is to be noted that the present invention is not limited to the described embodiments and many other changes and modifications may be made without departing from the scopes of the appended claims.

What is claimed is:

1. An outboard motor comprising:

an engine holder;

an engine which is disposed above the engine holder in a state wherein the outboard motor is mountable to a hull and in which a crankshaft is extendable substantially perpendicularly;

an oil pan disposed below the engine holder;

a drive shaft housing disposed below the oil pan;

an exhaust passage formed in the engine, the engine holder and the oil pan for discharging an exhaust gas from the engine in the drive shaft housing;

a cooling water passage and a return-water passage disposed in a vicinity of the exhaust passage; and fixing means disposed in the engine holder for fixing the oil pan to the engine holder, wherein said oil pan comprises vertical wall sections and outer wall sections, said outer wall sections being disposed outside the vertical wall sections, by which said exhaust passage, said cooling water passage and said return-water passage are formed, a juncture portion is formed between the engine holder and the oil pan, and said fixing means is provided for said vertical wall sections.

2. An outboard motor according to claim 1, wherein said engine holder and said oil pan are provided with outer wall sections forming said exhaust passage, said cooling water passage and said return-water passage and forming said juncture portion between the engine holder and the oil pan, said outer wall sections being connected to the engine by fixing means at a plurality of locations.

3. An outboard motor according to claim 1, wherein said engine holder and said oil pan are provided with vertical wall sections forming said exhaust passage, said cooling water passage and said return-water passage and forming a juncture portion between the engine holder and the oil pan, said vertical wall sections being connected by means of a rib, and said fixing means being provided at an intersection between said vertical wall sections and said rib.

4. An outboard motor according to claim 3, wherein said engine holder and said oil pan are provided with outer wall sections forming said exhaust passage, said cooling water passage and said return-water passage and forming said juncture portion between the engine holder and the oil pan, said outer wall sections being connected to the engine by fixing means at a plurality of locations.

5. An outboard motor comprising:

an engine holder;

an engine which is disposed above the engine holder in a state of the outboard motor being mountable to a hull and in which a crankshaft is extendable substantially perpendicularly;

an oil pan disposed below the engine holder;

a drive shaft housing which is disposed below the oil pan and in which an exhaust chamber is formed and the drive shaft extends vertically;

a water pump driven by the drive shaft so as to pump up cooling water;

a cooling water passage formed in the oil pan and the drive shaft housing to guide the cooling water pumped up by the water pump to the engine; and a relief valve in communication with the cooling water passage so as to discharge the cooling water into the exhaust chamber, said oil pan being provided, at a bottom surface thereof, with a horizontal cooling water passage which extends in a horizontal direction and to which the cooling water is guided from the water pump, provided with a vertical cooling water passage extending towards the engine from an intermediate portion of said horizontal cooling water passage and provided with a relief port disposed at a portion upstream side of a connecting portion of said horizontal and vertical cooling water passages so as to be opened towards the exhaust chamber, said relief valve being mounted to said relief port.

6. An outboard motor according to claim 5, wherein said bottom surface of the oil pan is vertically staged to provide a low level portion and a high level portion and an oil drain port is formed to a wall section of the oil pan at the low level portion side.

7. An outboard motor according to claim 5, wherein said oil pan is formed, at the bottom surface thereof, with a boss for mounting the relief valve.

* * * * *